United States Patent [19]

Stephens

[11] Patent Number: 4,662,345

[45] Date of Patent: May 5, 1987

[54] SEMI-AUTOMATIC CROSSBOW APPARATUS AND METHOD

[76] Inventor: Floyd Stephens, Rte. 6, Box 63, Austin, Tex. 78737

[21] Appl. No.: 660,791

[22] Filed: Oct. 15, 1984

[51] Int. Cl.[4] ..... F41B 5/00; F41B 11/00; F41C 25/00; F41C 17/00; F41C 19/00

[52] U.S. Cl. ..... 124/25; 124/52; 124/40; 124/35 R; 124/80

[58] Field of Search ..... 124/17, 22, 25, 35 R, 124/52, 53

[56] References Cited

U.S. PATENT DOCUMENTS

| | | | |
|---|---|---|---|
| 2,918,050 | 12/1959 | Kopman | 124/25 |
| 3,125,998 | 3/1964 | Stevens | 124/25 |
| 3,561,419 | 2/1971 | Cucuzza | 124/25 |
| 3,739,765 | 6/1973 | Moore | 124/25 |
| 3,968,783 | 7/1976 | Pfotenhauer | 124/25 |
| 4,169,456 | 10/1979 | Van House | 124/25 |

*Primary Examiner*—Richard C. Pinkham
*Assistant Examiner*—Benjamin Layno
*Attorney, Agent, or Firm*—John Nevin Shaffer, Jr.

[57] ABSTRACT

Apparatus and method of providing for a semi-automatic crossbow embodying a new cocking device and a new magazine. The cocking device consists of a pulley system mounted to the frame of the crossbow and operated by a filament. The crossbow is cocked by holding the grip of the device in one hand, and pulling the cocking handle with the other hand. Each time the crossbow is cocked, a pulley carriage is automatically returned to its original position by use of springs or elastic bands. The device may be fired as quickly as the device may be cocked and trigger pulled. A clip device is utilized to hold bolts to be fired. The bolts are stacked vertically and spring fed upwardly to the chamber each time the crossbow is cocked. The bolts are held in place by constant spring pressure against the bolt track along which the bolt are driven. The clip utilizes two arms that scissor upward and raise the bolts substantially levelly. The invention also incorporates a three (3) piece trigger system with a positive safety, a folding stock a belt clip, and adjustable sights. The entire device may be disassembled with the use of only a screw driver, a pair of pliers, and an allen wrench.

7 Claims, 15 Drawing Figures

SEMI-AUTOMATIC CROSSBOW APPARATUS AND METHOD

BACKGROUND OF THE INVENTION

1. Field of the Invention

This invention pertains to a device designed to provide for a semi-automatic crossbow. The gist of the invention is a compound cocking mechanism which enables the user to cock the device quickly and easily. The device further incorporates a unique detachable clip capable of holding several arrows, or bolts as they are more commonly described, stacked one on top of the other. Said clip is completely enclosed in the frame of said crossbow when loaded. Each time the compound draw cocking mechanism is utilized a bolt is chambered and made available for firing. Further, the device is equipped with a folding stock so it may be fired as a piston or from the shoulder as a rifle. The cocking handle may be moved from one side to the other to allow for either right or left hand cocking. Additionally, the device incorporates a safety mechanism on either side of the trigger and has the unique ability to disarm a cocked and loaded device, should that be desired, without the necessity of firing the device. Further, all that is needed to disassemble the device so that it may be carried in a small bag is an allen wrench. The device weighs very little, approximately four (4) pounds nine (9) ounces, is fourteen and a half ($14\frac{1}{2}$) inches long and can be completely dismantled with only a screw driver, a pair of pliers and an allen wrench.

2. Description of the Prior Art

While there are numerous types of crossbows, to the best of this inventor's knowledge, there has never been an invention such as this which is capable of rapid and easy cocking and automatic loading of bolt after bolt. In this inventor's experience, every device that has been designed to attempt to provide for a semi-automatic, rapid firing crossbow has failed in this attempt in that they are not really semi-automatic nor rapid firing primarily because they are hard to cock. This problem stems from the fact that for a crossbow to be effective it must have a powerful prod, bow, that requires substantial effort to cock. Secondly, previous crossbows had only the capacity for single shot use, necessitating a long reloading time. A third and substantial draw back of previous devices has been the bulky shape and heavy weight associated with them.

To overcome the problem of difficulty in cocking, previous crossbows have utilized various cocking devices. Such cocking devices have included separate devices or devices built into the crossbow itself. One of the most common of these cocking devices is a stirrup mounted on the front end of the crossbow. To cock such a crossbow with a stirrup, one is required to place the stirrup on the ground, put a foot into the stirrup and, using body weight to hold the crossbow down, pull back on the bow string with both hands. Other devices have utilized a lever to assist in cocking, but this lever must be carried separately and be attached to the crossbow each time the weapon is to be cocked. It is obvious that, for a crossbow to be effective, it must first have an effective cocking device capable of handling today's high strength composit prods. The draw weights on today's crossbows range from thirty (30) to two hundred fifty (250) pound pull draw weights, being limited only by the amount of leverage a cocking device provides. As described, previous crossbows have not been able to overcome this serious cocking problem.

Slow reloading time is the second most significant drawback of the modern crossbow. None of the crossbows currently manufactured have rapid fire capabilities. The typical crossbow must first be cocked and then the bolt placed in a tract or groove each time the crossbow is to be shot. While previous devices have disclosed magazines capable of holding more than one bolt, the typical crossbow relies on gravity to hold the bolt in place, requiring the user to hold the crossbow level in order to prevent the bolt from shifting or falling from the device. Even though numerous modifications have been developed in the area of multiple fire crossbows, none have been simple and/or particularly effective. The ideal crossbow should be capable of storing and launching a plurality of projectiles, bolts, in a rapid sequence. For this to be accomplished the cocking device and magazine must work in unison. That is, each time the crossbow is cocked a bolt must be loaded and ready to shoot. Along with these mechanical features, a crossbow should be powerful, light weight, compact and easy to load and shoot.

SUMMARY OF THE INVENTION

This invention consists of a semi-automatic crossbow embodying a new cocking device and a new magazine that work together to produce a rapid fire crossbow. The cocking device consists of a pulley system mounted to the frame of the crossbow through which a filament is strung. This pulley filament is attached at both ends to both sides of the device, both of which ends are capable of receiving a cocking handle. The crossbow is cocked by holding the grip of the crossbow in one hand, the cocking handle in the other and pulling the handle while pushing the crossbow away from the body, thereby using the weight of the crossbow to help cock the device. The number of pulleys used determines the draw weight reduction ratio. Such a mechanical advantage makes it possible to utilize stronger, yet smaller, prods with draw weights of over three hundred (300) pounds. Said draw weight reduction ratio may range from two (2) to one (1) up to eight (8) to one (1) depending on draw weight of the prod and the length of the cocking stroke desired. With a four (4) to one (1) ratio, the effort needed to cock a one hundred fifty (150) pound pull prod would be one-fourth ($\frac{1}{4}$) of the draw weight of the prod, or thirty-seven and a half ($37\frac{1}{2}$) pounds in weight and four (4) times the draw length in distance. Each time the crossbow is cocked, a pulley carriage is automatically returned to its original position by use of a carriage return means. Further, the crossbow described herein is unique in that it may be uncocked without firing a bolt by drawing the cocking handle back, releasing the trigger and slowly allowing the cocking handle to retract to its original position.

As described herein, the clip device utilized to hold the bolts may consist of either a detachable clip or a built in clip. In both the bolts are stacked vertically and spring fed upward to the chamber each time the crossbow is cocked. The number of bolts that the clip can hold is determined by the design of the crossbow, since the clip is enclosed in the frame. This magazine differs from most other devices because the bolts are fed vertically upward and are held in place, by constant spring pressure, against the track along which the bolt will be driven. This clip utilizes two arms pivotally connected together so that they scissor upward and raise the bolts substantially levelly. The detachable clip loads from the bottom of the frame through a hinge plate that has springs mounted to it that provide the upward force on the scissor arms. An internal clip is conceived which works in the same way, but loads one bolt at a time through the top of the frame of the device. The arms and springs of the internal clip are mounted within the stock and function in the same manner as said external clip.

This combination of a compound draw cocking mechanism and a clip feed make it possible to shoot bolts at the approximate rate of one (1) per second. Besides these two main features, the present invention has many additional unique and usefull features. It incorporates a simple three (3) piece trigger system with a positive safety; may be equiped with a folding stock so that it may be fired as a pistol or from the shoulder as a rifle; has a belt clip so that it may be holstered at the side; has adjustable sights which are graduated for trajectory compensation and the entire device may be disassembled with the use of a screw driver, a pair of pliers and an allen wrench. The preferred embodiment of the crossbow is constructed of alluminum, stainless steel and brass. It is rugged, yet only weighs approximately four (4) pounds nine (9) ounces and is only fourteen and a half (14½) inches long.

The object of the invention is to provide a device that is easy to cock, reload, transport, repair, maintain and inspect. Further, the device, while providing for said semi-automatic use, is rugged, easy to disassemble and relatively inexpensive to produce.

BRIEF DESCRIPTION OF THE DRAWINGS

For a description of the construction and operation of the device of this invention, reference is made to the attached drawings and identical reference characters will be utilized to refer to identical or equivalent structures throughout the various views of the following detailed descriptions.

DETAILED DESCRIPTION

Figure 1:
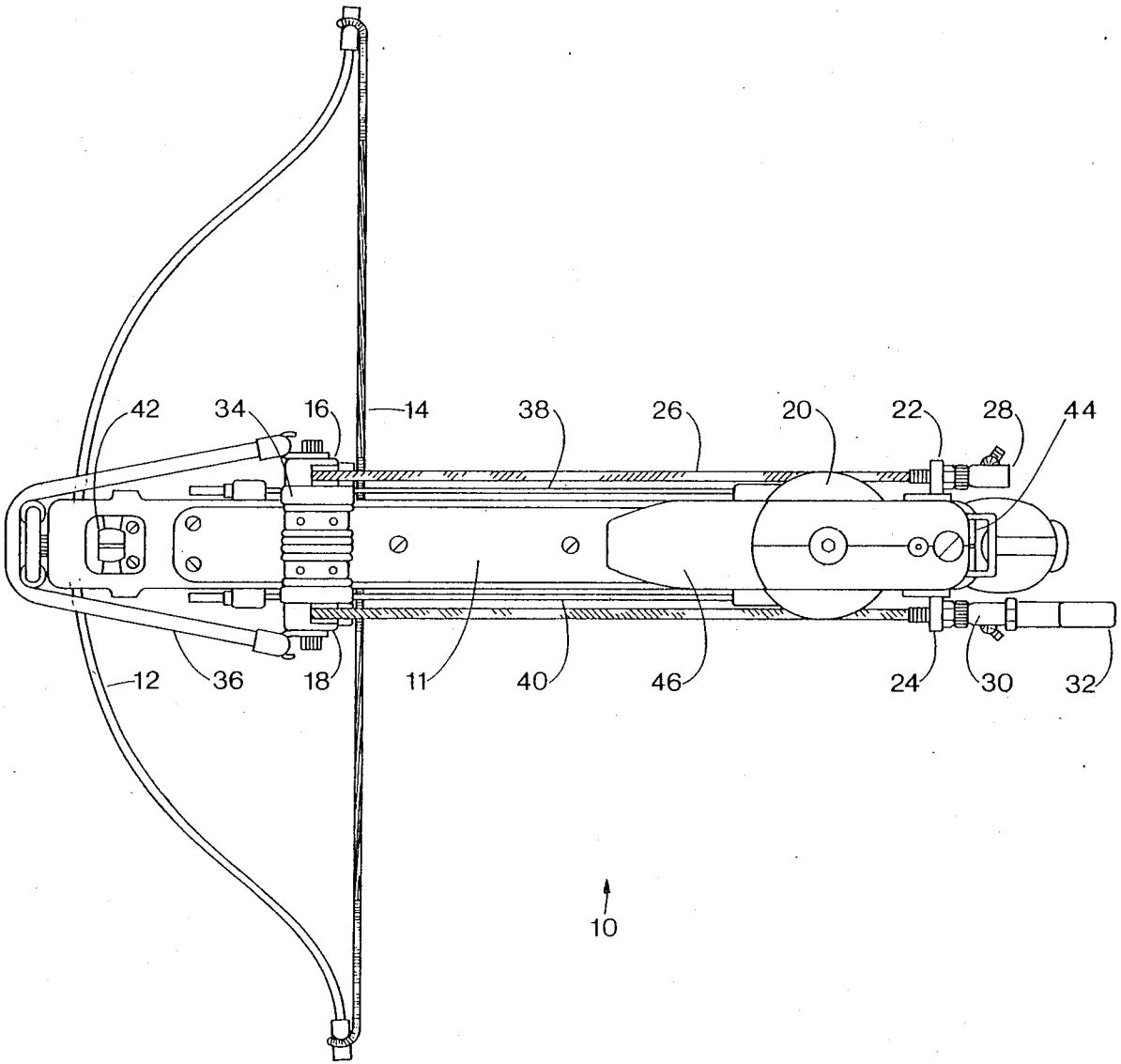
FIG. 1 is a top view, uncocked.

Referring to FIG. 1, 10 denotes the invention itself consisting of frame 11, prod 12 attached to said frame 11 and bow string 14 attached to said prod 12. Also illustrated are two (2) oppositely attached forward pulleys 16 and 18 and a larger top rear pulley 20. Two (2) oppositely positioned pulley filament guides 22 and 24 are securably attached below said large pulley 20 to said frame 11. Pulley filament 26 is securably attached to a pulley filament guide bracket 28 attached to said pulley pulley filament guide 22. In this illustration, said pulley filament 26 passes through said pulley filament guide 22 forward to forward pulley 16 rearwardly to said large top pulley 20 forward again to said small forward pulley 18 rearwardly through said pulley filament guide 24 and is securably attached to pulley filament guide bracket 30. Cocking handle 32 is provided and may be attached to either said pulley filament guide bracket 28 or 30. Said small forward pulleys 16 and 18 are attached to pulley carriage 34 while carriage return 36 is outwardly attached to said small forward pulleys 16 and 18. Also illustrated are carriage slides 38 and 40, front sight 42, rear sight 44 and belt clip 46.

Figure 2:
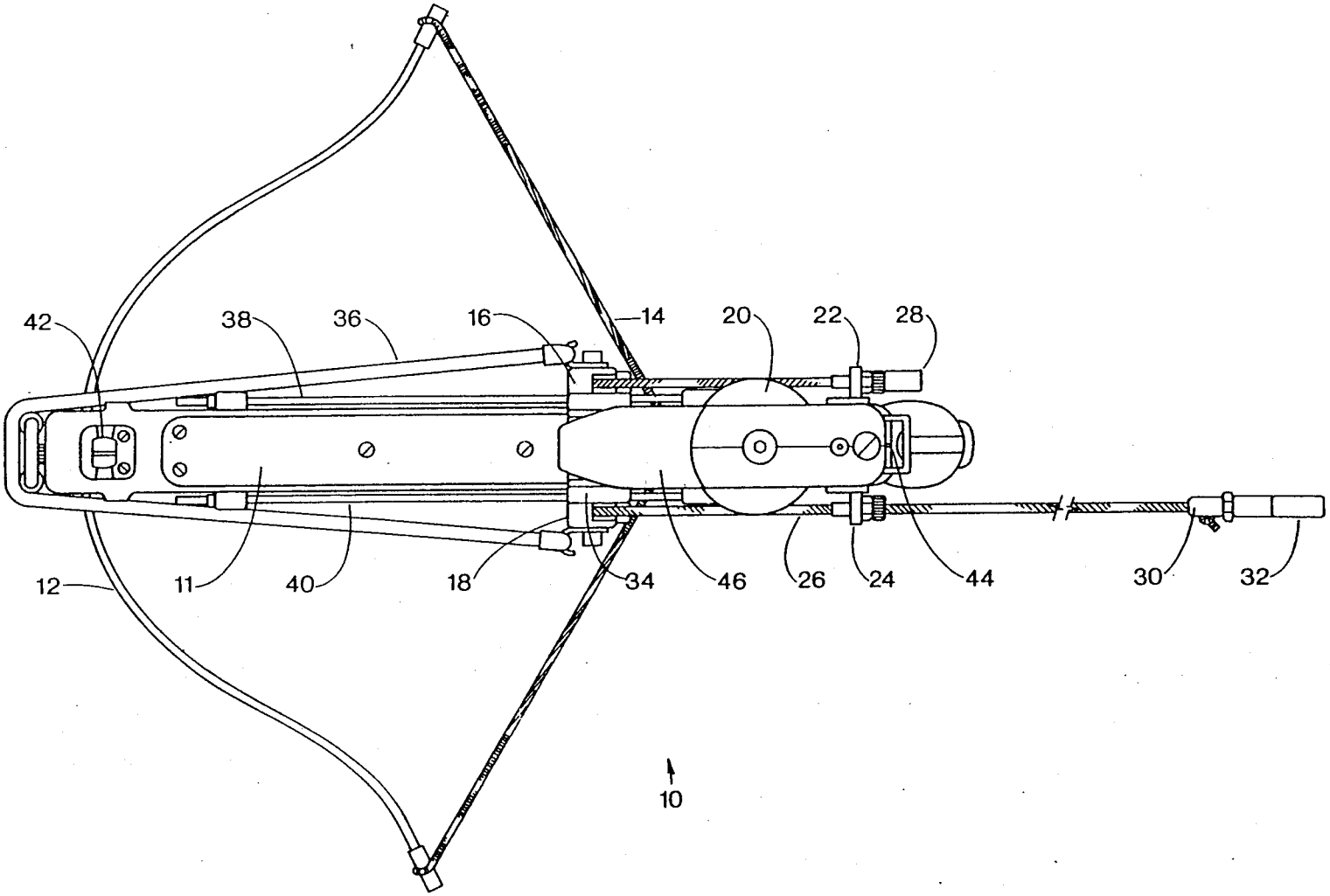
FIG. 2 is a top view, cocked, carriage back.
Figure 3:
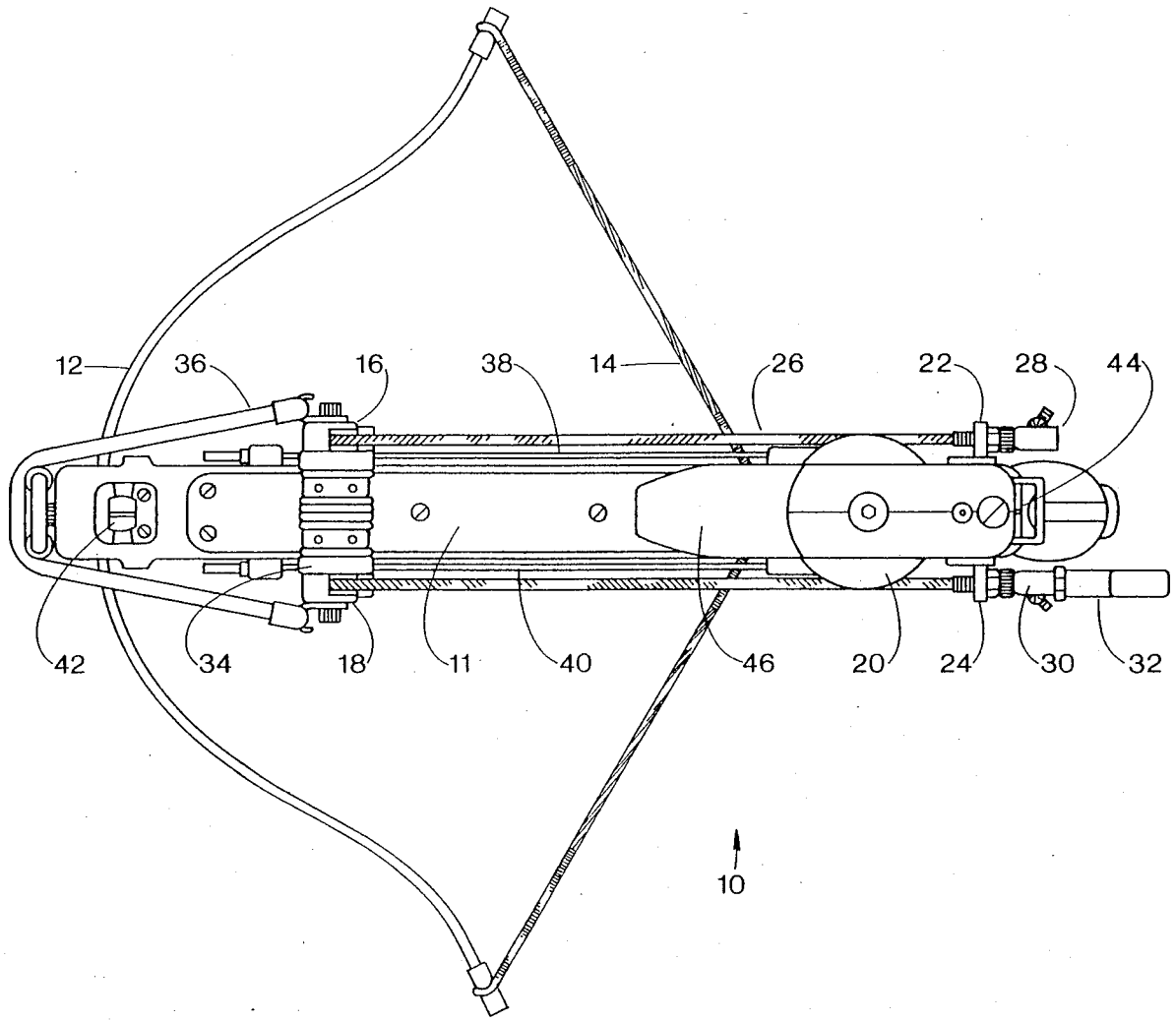
FIG. 3 is a top view, cocked, carriage forward.

Referring to FIG. 2, device 10 is cocked with said carriage return 36 illustrated in its tensioned position with said pulley carriage 34 shown in its rear most position underneath said belt clip 46. FIG. 3 illustrates device 10 in its cocked position with said pulley carriage 34 restored to its forward position by said carriage return 36.

Figure 4:
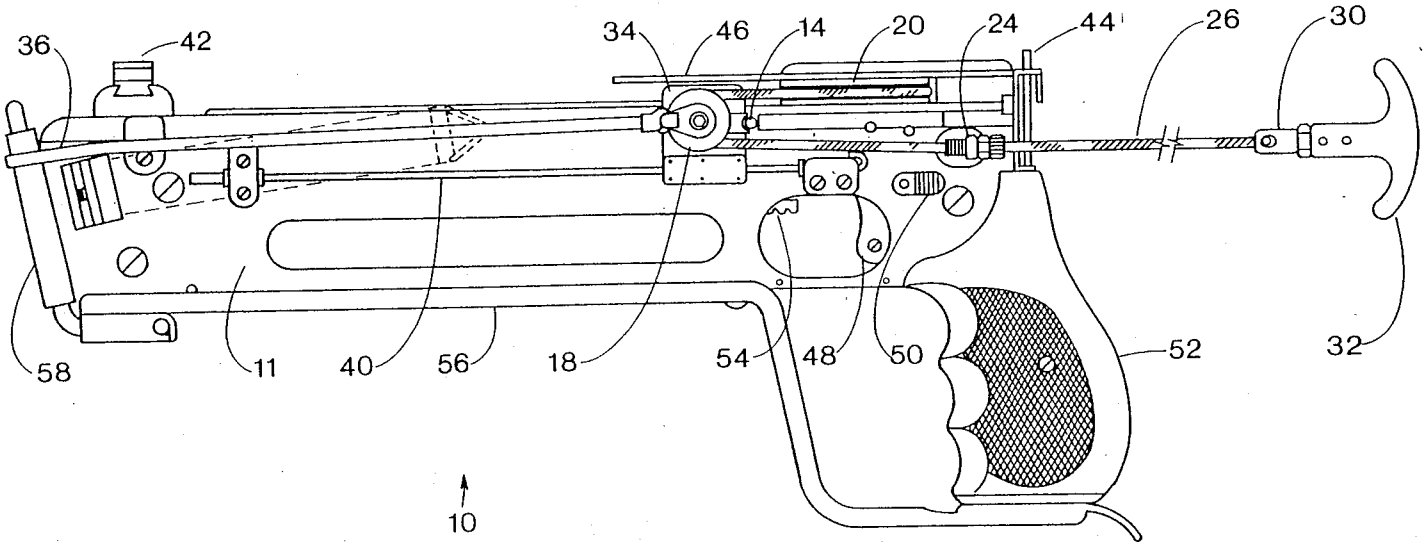
FIG. 4 is a side view, cocked, carriage back.

Referring to FIG. 4, a side view of said device 10 is illustrated. Said device 10 is in the cocked position with said pulley carriage 34 in its rearmost position. Also illustrated is trigger 48, safety 50 shown in the off position, grip 52, clip release button 54 and folding stock 56 shown in the folded position. Also illustrated is reversable, detachable shoulder plate 58 attached to the front of said folding stock 56 and held in position by said carriage return 36.

Figure 5:
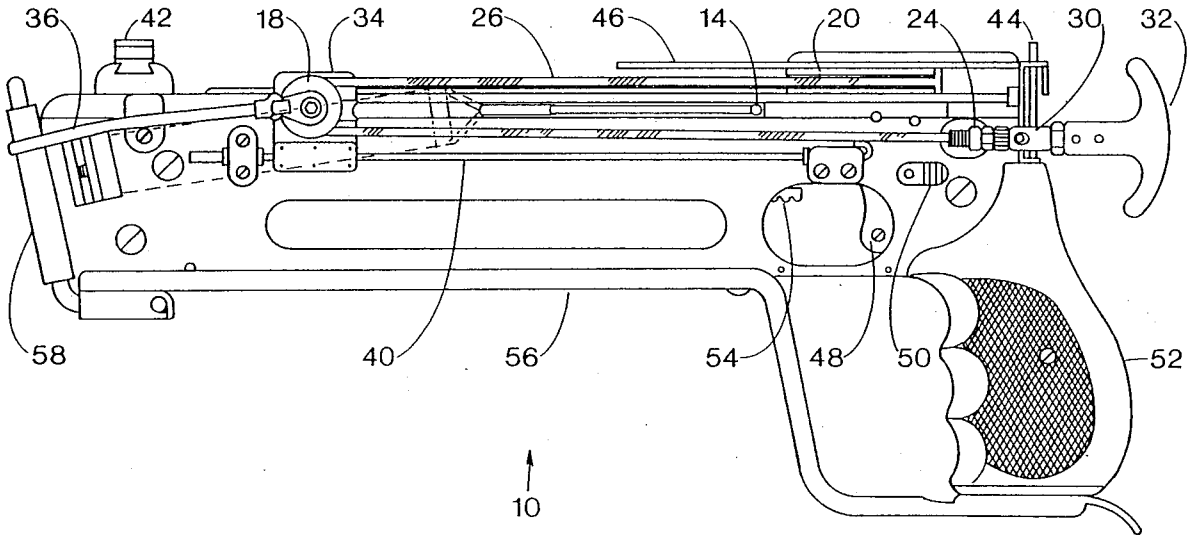
FIG. 5 is a side view, cocked, carriage forward.
Figure 6:
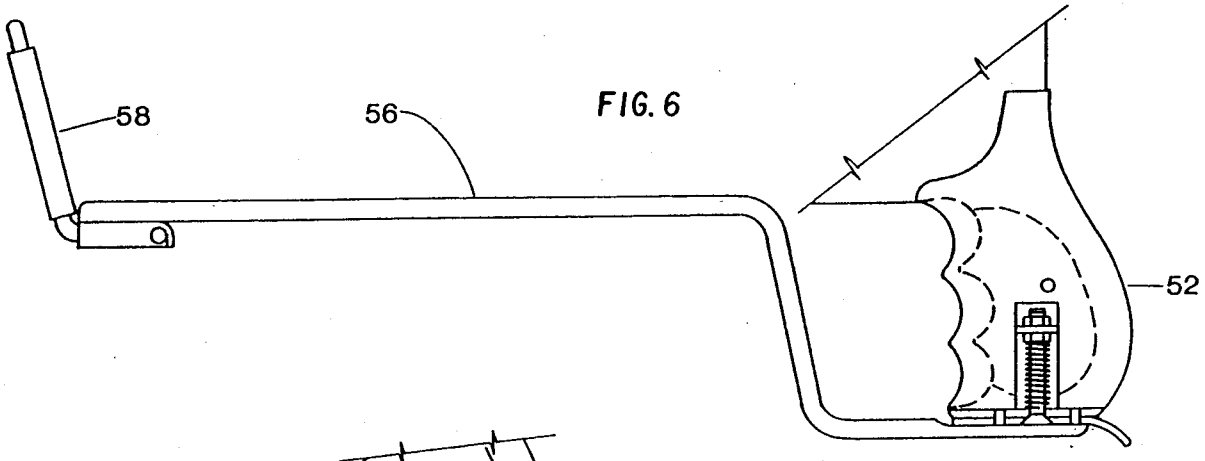
FIGS. 6, 6A and 6B are isolated side views of the folding stock, folded and extended.
Figure 6A:
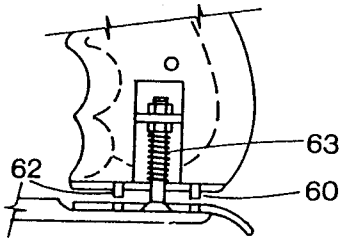
Figure 6B:
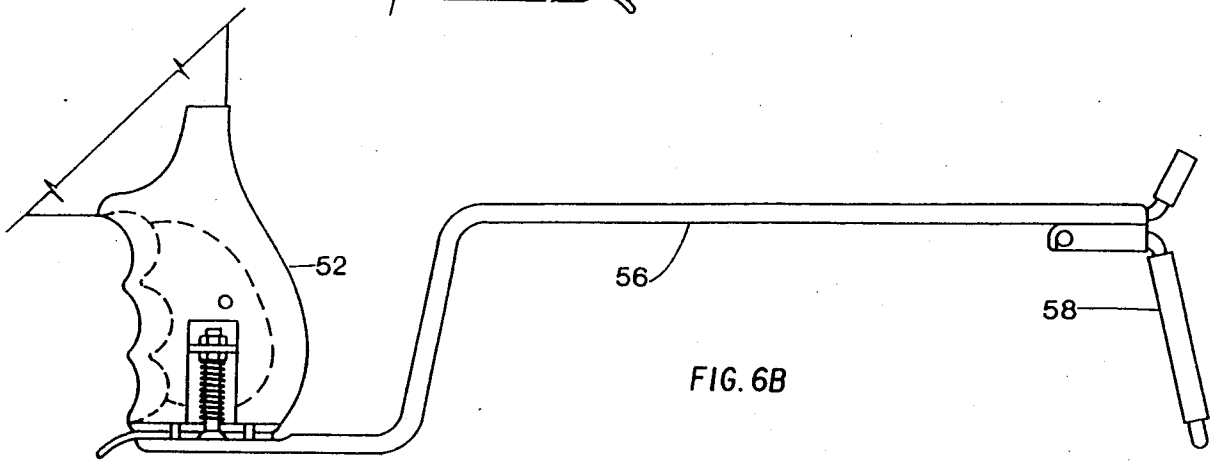

Referring to FIG. 5, said device 10 is illustrated in the cocked position with said pulley carriage 34 in its forward position. Bow string 14 is shown in its rear cocked position. FIG. 6 demonstrates a close up of said folding stock 56 in the folded and extended position. The base of said folding stock 56 is a attached to grip 52 and held in place by a screw and detents 60 and 62. Spring 63 holds said base of said folded stock 56 in either the folded or extended position in conjunction with said detents 60 and 62. Said reversable detachable shoulder plate 58 is shown in its stored position on the folded stock and in its ready position on the extend stock.

Figure 7:
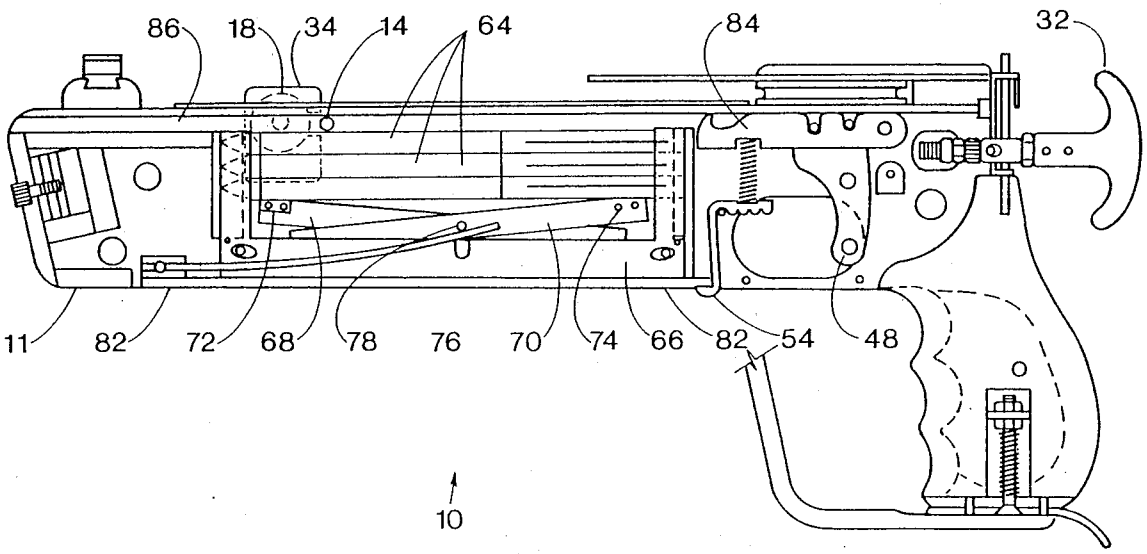
FIG. 7 is a side view, uncocked, showing bolts loaded in clip.

Referring to FIG. 7, device 10 is illustrated in the side view in the uncocked position. Illustrated by phantom lines are pulley carriage 34 and pulley 18. Bow string 14 is shown in the forward, uncocked position. Bolts 64 are shown loaded in clip 66, supported by clip arms 68 and 70. In this illustration, bolt support pad 72 and 74 are shown with bolt support pads 72 facing towards the viewer and bolt support pad 74 facing away from the viewer.

Also illustrated in FIG. 7 is clip spring pin 76 which loosely attaches said clip arms 68 and 70 and protrudes past the edges of said clip 66. Said clip spring 76 is engagably contacted by two (2) oppositely positioned, upwardly curving clip springs 78 and 80. In this illustration, only said upwardly curving clip spring 78 is visable. Also illustrated is the base of said clip release button 54 shown engagably attached to magazine door 82. Said magazine door 82 is rotatably attached to said frame 11 near the front underside of said frame 11. FIG. 7 also illustrates interiorly located bow string catch 84 securably attached to said trigger 48. Said bow string 14 when in the uncocked position as illustrated in FIG. 7, keeps said bolts 64 from reaching the loaded position.

Figure 8:
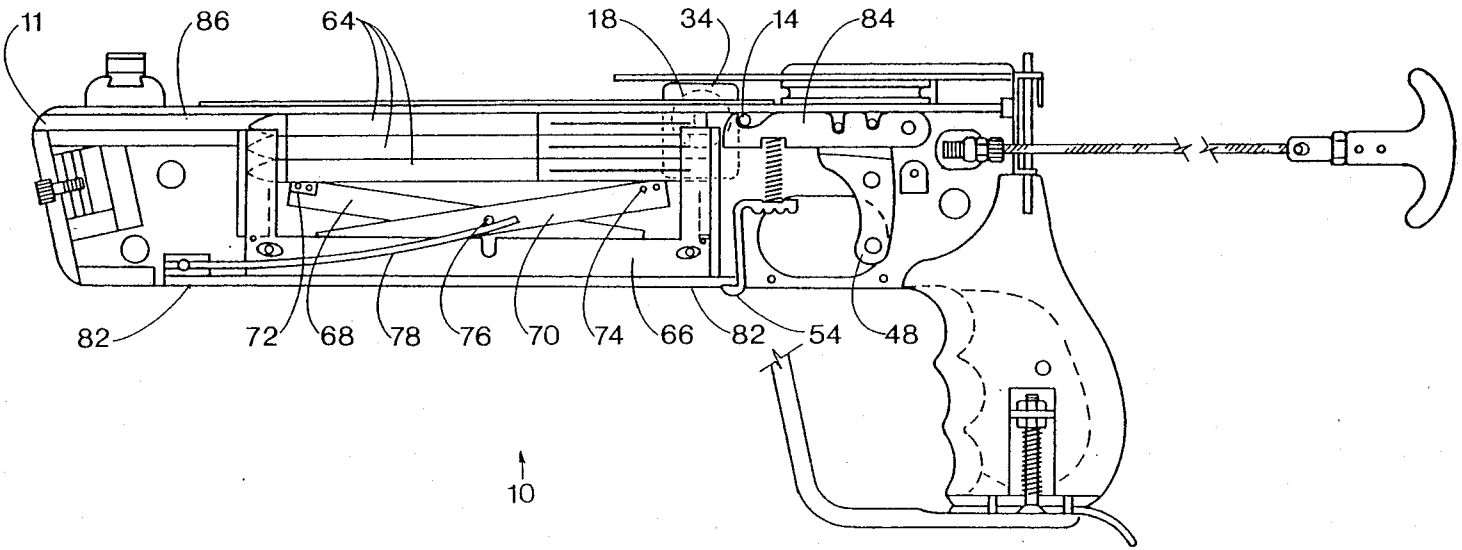
FIG. 8 is a side view, cocked, carriage back, showing bolt loaded.

FIG. 8 is a side view of device 10 in a cocked position. Bow string 14 is shown held in the cocked position by bow string catch 84. Pulley carriage 34 is shown in its rearward position and the top most bolt of said bolts 64 is shown positioned in bolt track 86, ready for firing. This view demonstrates how bow string 14, when in the cocked position, allows bolt 64 to be pressed all the way up into said bolt track 86 by clip arms 68 and 70 in conjunction with clip spring pin 76 and said upwardly curving clip springs 78 and 80.

Figure 9:
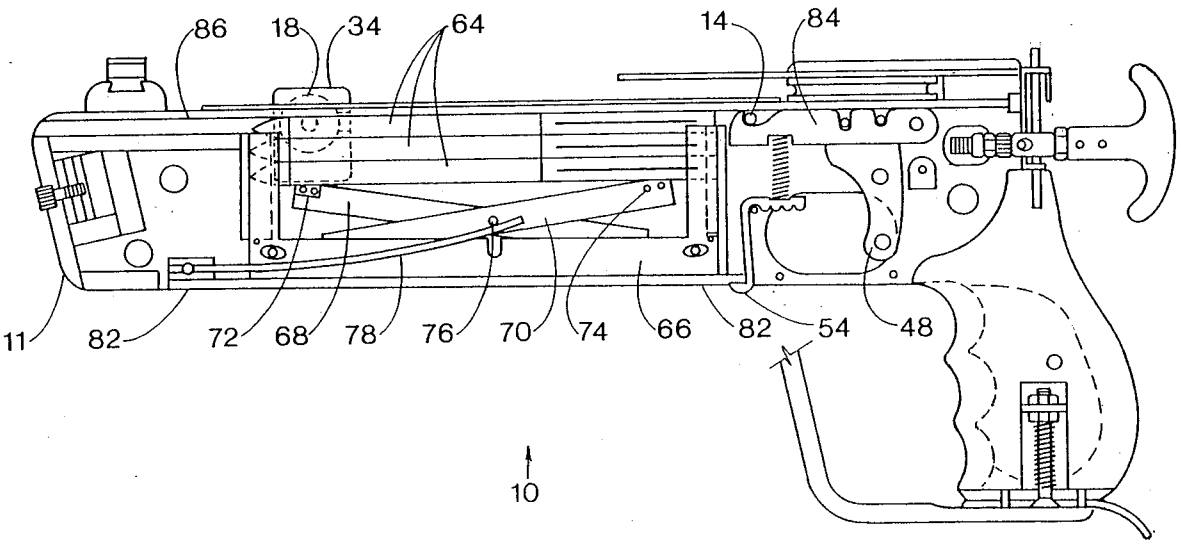
FIG. 9 is a side view, cocked, carriage forward, showing bolt loaded.

FIG. 9 is a side view of device 10 in the cocked position. Bolt 64 is loaded and said pulley carriage 34 has been returned to its forward position by said pulley carriage return 36 (not shown).

Figure 10:
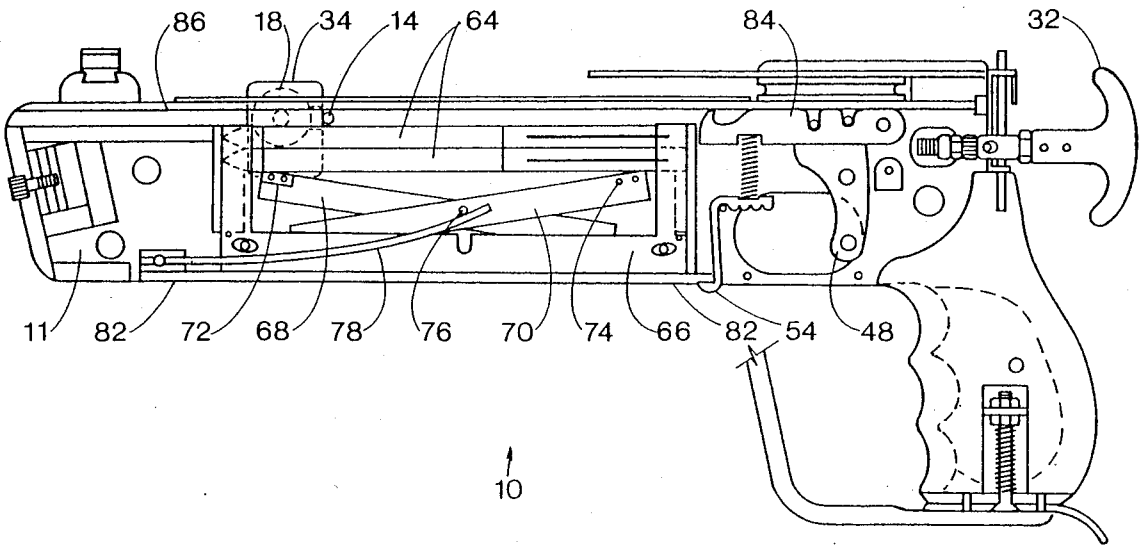
FIG. 10 is a side view, uncocked, one less bolt in clip.

FIG. 10 illustrates said device 10 in side view, uncocked. Said pulley carriage 34 is in its forward position, as is said bow string 14. Because said device 10 has been fired, there is one less bolt 64, in said clip 66.

Figure 11A:
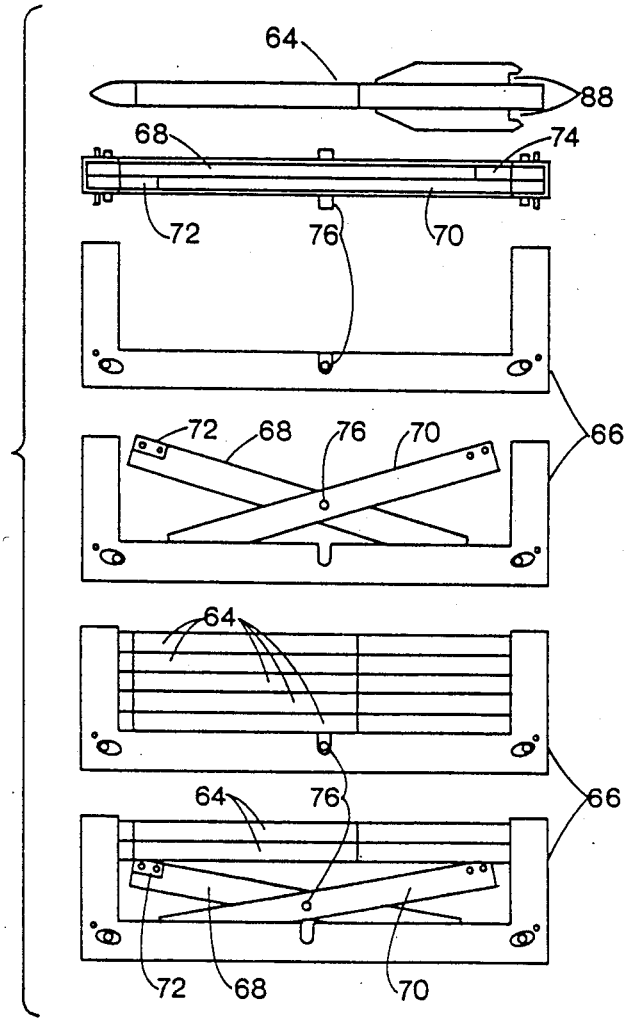
FIGS. 11A and 11B are top and side views of the clip and trigger means.
Figure 11B:
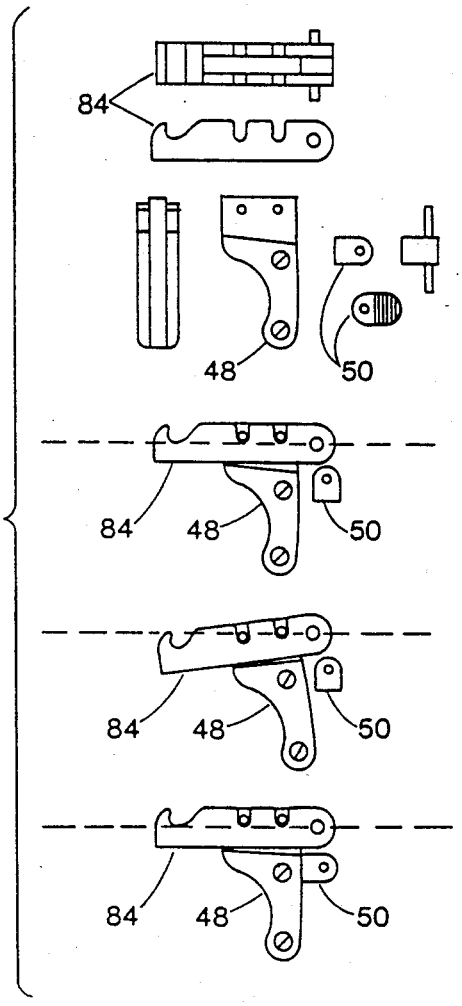

FIG. 11 illustrates top and side views of the clip and trigger means. Bolts 64 are shown with clip securing notches 88 and clip side views (a)–(d) show said clip 66 empty (a); empty, clip arms 68 and 70 raised (b); full (c) and partially full, clip arms 68 and 70 raised (d).

Further, bow string catch 84 is shown in top view. Trigger side views (a)–(c) show trigger 48 and bow string catch 84 connected with safety 50 in the off position (a); trigger 48 and bow string 84 in the firing position, safety 50 off (b); and safety 50 in the on position (c).

Figure 12:
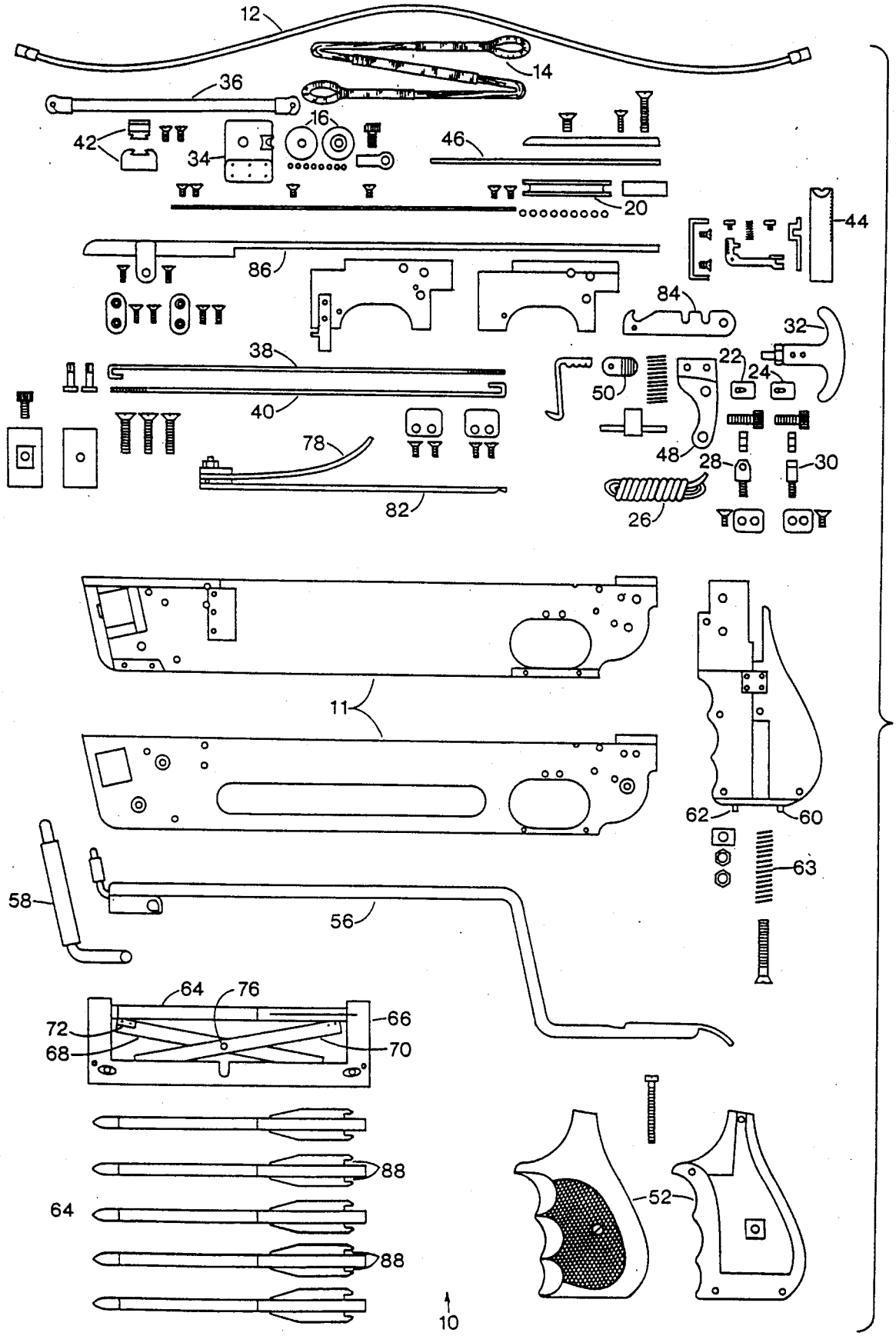
FIG. 12 is an exploded view of the parts of the device.

Referring to FIG. 12, the device 10 is illustrated in its completely disassembled state. Previously identified components have been numbered to correspond with their given numbers while additional bolts, allen screws, spacers, etc., have been left unnamed but illustrated.

In use, the device 10 enables the user to rapidly cock and fire a crossbow. This is accomplished, in this embodiement, through utilization of two (2) oppositely attached forward pulleys 16 and 18 in conjunction with a larger top rear pulley 20. A pulley filament 26 is connected through said pulleys 16, 18 and 20 to two (2) pulley filament guide brackets 28 and 30, both of which are adapted to receive cocking handle 32. Depending on whether the user is right or left handed, cocking handle 32 is attached on one side or the other of said device 10. Device 10 is loaded by grasping the device by grip 52 in one hand and said cocking handle 32 in the other. While pulling back on said cocking handle 32 and swinging said device 10 away from the body, said pulley filament 26 draws pulley carriage 34 rearwardly along with said bow string 14 so that said bow string 14 is ultimately captured in bow string catch 84. Said pulley carriage 34 is returned to its forward position by carriage return means 36. As said bow string 14 is drawn rearwardly to said bow string catch 84, two (2) upwardly curving clip springs 78 and 80 raise two (2) clip arms 68 and 70 within magazine clip 66 so that bolts 64 are raised levelly. With said bow string 14 captured in said bow string catch 84, said upwardly curving clip springs 78 and 80 drive the top most of said bolts 64 into bolt track 86. Device 10 is now armed. Rotating safety 50 so that it parallels the ground removes the safety from trigger 48. Aligning rear sight 44 and front sight 42 and pressing said trigger 48 depresses said bow string catch 84 thereby releasing said bow string 14 and allowing said bow string 14 to propel said bolt 64 forward along bolt track 86 and away from said device 10. Repeating the above described procedure takes a second or less and, therefor, all of said bolts 64 may be fired in a rapid semi-automatic manner.

When said clip 66 is empty, magazine clip release 54 is depressed so that magazine door 82 is released to swing downwardly to allow said clip 66 to be removed and reloaded. Device 10 may be attached to the users belt by use of belt clip 46 while said clip 66 is reloaded with bolts 64. Once said clip 66 is loaded, reversing the procedure fully loads said device 10 so that it is ready for firing once again.

In the event that device 10 has been armed as previously described and the user desires to disarm the weapon, the device 10 may be safely disarmed by the following procedure. The device is held by grip 52 and said cocking handle 32. Said cocking handle 32 is drawn to its full extension so that said pulley carriage 34 is resting up against bow string catch 84, in the rear position. With safety 50 in the off position, said trigger 48 is pulled so that said bow string 14 rests against said pulley 34. Said cocking handle 32 is then slowly allowed to retract into the device as said carriage return 36 pulls said pulley carriage 34 forward. Said device 10 is controllably unloaded as a result of this method and with said safety 50 in the on position said device is now loaded but unarmed.

Thus, according to this invention, a plurality of crossbow bolts may be preloaded in a clip. With the clip inserted into the crossbow a compound cocking mechanism may be utilized to allow for rapid semiautomatic firing of all the bolts in the clip. The cocking mechanism is usable by either right or left handed people and the clip may be permanently located within the device if so desired. The device is easy to cock, reload, transport, repair, maintain and inspect. Further, the device, while providing for said semi-automatic use, is rugged, easy to disassemble and relatively inexpensive to produce.

Although the invention has been described in connection with the preferred embodiment, it is not intended to limit the invention to the particular form set forth, but, on the contrary, it is intended to cover alternatives, modifications, and equivalents as may be included within the spirit and scope of the invention as defined by the appended claims.

What is claimed is:

1. A crossbow apparatus comprising a means for cocking a crossbow and a means for loading said crossbow, wherein said means for cocking a crossbow includes:

(a) a support frame;
(b) a bow attached to said support frame;
(c) a bow string attached to said bow;
(d) a pulley carriage attached to the top of said support frame;
(e) two oppositely positioned smaller forward pulleys attached to the sides of said pulley carriage
(f) one larger pulley securably attached to the top rear of said support frame;
(g) two oppositely positioned pulley filament guides, securably attached below said large pulley on said sides of said support frame;
(h) an elastic carriage return means attached to both sides of said pulley carriage and passing around the front of said support frame;
(i) a pulley filament guide bracket, securably attached to both of said pulley filament guides;
(j) a pulley filament securably attached to one of said pulley filament guide brackets, passing through one of said pulley filament guides forwardly to one of said oppositely positioned smaller forward pulleys then rearwardly to said large pulley then forwardly to the other said smaller pulley then rearwardly through the other said pulley filament guide and securably attached to the other said pulley filament guide bracket;

(k) a cocking handle removably attached to one of said pulley filament guide brackets;

(l) a trigger means attached to said support frame; and (m) a bowstring catch means attached to said trigger means.

2. Crossbow apparatus as recited in claim 1, wherein said means for loading said crossbow includes:

(a) a plurality of projectiles (b) a vertical stacking, upward feeding, projectile clip, equal in length and width to said projectiles for said crossbow, into which said projectiles are stacked;

(c) two projectile clip arms, one end of each of which is oppositely attached to the base of said projectile clip;

(d) a clip spring pin loosely attaching said projectile clip arms in the mid center of said arms and extending beyond the width of said projectile clip so that said arms scissor upwardly together when an upward force is applied to said clip spring pin;

(e) a projectile support pad attached to one end of each projectile clip arm for support of said projectile when raised;

(f) a magazine door rotatably attached to the forward underside of said support frame;

(g) two upwardly curving clip springs oppositely attached to either side of said magazine door at said rotatable attachment;

(h) a magazine door clip release means located above said trigger means; and (i) said projectiles having projectile fins adapted so that the projectile fins are notched to interlock with said vertical stacking, upward feeding, projectile clip thereby loosely securing said projectile in said clip.

3. Crossbow apparatus as recited in claim 2, wherein said means for loading comprises:

a vertical stacking, upward feeding projectile clip securably attached inside said support frame; and said support frame opens from the top to admit said projectiles.

4. A crossbow apparatus comprising:

(a) a support frame;

(b) a bow attached to said support frame;

(c) a bow string attached to said bow;

(d) a grip attached to said support frame;

(e) a pulley carriage attached to the top of said frame;

(f) two oppositely positioned smaller forward pulleys attached to the sides of said pulley carriage;

(g) one larger pulley securably attached to the top rear of said support frame;

(h) two oppositely positioned pulley filament guides, securably attached below said large pulley on said sides of said support frame;

(i) an elastic carriage return means attached to both sides of said pulley carriage and passing around the front of said support frame;

(j) a pulley filament guide bracket securably attached to both of said pulley filament guides;

(k) a pulley filament securably attached to one of said pulley filament guide brackets, passing through one of said pulley filament guides forwardly to one of said oppositely positioned smaller forward pulleys then rearwardly to said large pulley then forwardly to the other said smaller pulley then rearwardly through the other said pulley filament guide and securably attached to the other said pulley filament guide bracket;

(l) a cocking handle removably attached to one of said pulley filament guide brackets;

(m) a trigger means attached to said support frame;

(n) a bow string catch means attached to said trigger means;

(o) a plurality of projectiles (p) a vertical stacking, upward feeding, projectile clip, equal in length and width to said projectiles for said crossbow, into which said projectiles are stacked;

(q) two projectile clip arms, one end of each of which is oppositely attached to the base of said projectile clip;

(r) a clip spring pin loosely attaching said projectile clip arms in the mid center of said arms and extending beyond the width of said projectile clip so that said arms scissor upwardly together when an upward force is applied to said clip spring pin;

(s) a projectile support pad attached to one end of each projectile clip arm for support of said projectile when raised;

(t) a magazine door rotatably attached to the forward underside of said suport frame;

(u) two upwardly curving clip springs oppositely attached to either side of said magazine door at said rotatable attachment;

(v) a magazine door clip release means located above said trigger means; and (w) said projectiles having projectile fins adapted so that the projectile fins are notched to interlock with said vertical stacking, upward feeding, projectile clip thereby loosely securing said projectile in said clip.

5. Crossbow apparatus as recited in claim 4, wherein:

said support frame having a folded stock means extending the length of said frame, and adapted to be moved from a folded position to an extended position; said folding stock having a first end releasably attached to the base of said grip of said support frame by locking pins, and a second end having a reversible shoulder plate attached thereto; said second end is held in the folded position by said carriage return means;

said grip of said support frame is adapted to provide for an adjustable rear sighting means; and said support frame has a belt clip securably attached to the top of said support frame.

6. A method of providing for a rapid fire crossbow comprising the steps of:

(a) attaching a bow to a support frame;

(b) attaching a bow string to said bow;

(c) attaching a grip to said support frame;

(d) attaching a pulley carriage to the top of said support frame;

(e) attaching two oppositely positioned smaller forward pulleys to the sides of said pulley carriage;

(f) attaching a larger pulley to the top rear of said support frame;

(g) attaching two oppositely positioned pulley filament guides below said larger pulley on said sides of said support frame;

(h) attaching an elastic carriage return means to both sides of said pulley carriage and passing it around the front of said support frame;

(i) attaching a pulley filament guide bracket to both of said pulley filament guides;

(j) attaching a pulley filament to one of said pulley filament guide brackets and passing said pulley filament through one of said pulley filament guides forwardly to one of said oppositely positioned smaller forward pulleys then rearwardly to said large pulley then forwardly to the other said smaller pulley then rearwardly through the other said pulley filament guide and attaching said pulley filament to the other of said pulley filament guide bracket;

(k) attaching a cocking handle to one of said pulley filament guide brackets;

(l) attaching a trigger means to said support frame;

(m) attaching a bow string catch means to said trigger means;

(n) providing a plurality of projectiles;

(o) providing a vertical stacking, upward feeding, projectile clip, equal in length and width to said projectiles for said crossbow, into which said projectiles are stacked;

(p) oppositely attaching one end of two projectile clip arms to the base of said projectile clip;

(q) attaching a clip spring pin to said projectile clip arms in the mid center of said arms and extending beyond the width of said projectile clip so that said arms scissor upwardly together when an upward force is applied to said clip spring pin;

(r) attaching a projectile support pad to one end of each projectile clip arm for support of said projectile when raised;

(s) rotatably attaching a magazine door to the forward underside of said support frame;

(t) oppositly attaching two upwardly curving clip springs to either side of said magazine door at said rotatable attachment;

(u) providing a magazine door clip release means located above said trigger means; and (v) said projectiles having projectile fins adapted so that the projectile fins are notched to interlock with said vertical stacking, upward feeding, projectile clip thereby loosely securing said projectile in said clip.

7. Rapid fire crossbow method as recited in claim 6, wherein;

said support frame providing a folded stock means extending the length of said frame, and adapted to be moved from a folded position to an extended position; said folding stock having a first end releasably attached to the base of said grip of said support frame by locking pins, and a second end providing a reversible shoulder plate attached thereto; said second end is held in the folded position by said carriage return means;

said grip of said support frame is adapted to provide for an adjustable rear sighting means; and said support frame is provided with a belt clip securably attached to the top of said support frame.

* * * * *